US010933426B2

(12) United States Patent
Leonardi

(10) Patent No.: US 10,933,426 B2
(45) Date of Patent: Mar. 2, 2021

(54) MACHINE FOR GRINDING FOOD

(71) Applicant: Giorgio Leonardi, Bologna (IT)

(72) Inventor: Giorgio Leonardi, Bologna (IT)

( * ) Notice: Subject to any disclaimer, the term of this patent is extended or adjusted under 35 U.S.C. 154(b) by 363 days.

(21) Appl. No.: 15/026,450

(22) PCT Filed: Sep. 30, 2014

(86) PCT No.: PCT/EP2014/070953
§ 371 (c)(1),
(2) Date: Mar. 31, 2016

(87) PCT Pub. No.: WO2015/049240
PCT Pub. Date: Apr. 9, 2015

(65) Prior Publication Data

US 2016/0236202 A1 Aug. 18, 2016

(30) Foreign Application Priority Data

Oct. 2, 2013 (IT) ..... BO2013A000540

(51) Int. Cl.
*B02C 18/30* (2006.01)
*B02C 18/36* (2006.01)

(52) U.S. Cl.
CPC ..... *B02C 18/305* (2013.01); *B02C 18/301* (2013.01); *B02C 18/302* (2013.01); *B02C 18/365* (2013.01)

(58) Field of Classification Search
CPC ... B02C 18/365; B02C 18/301; B02C 18/302; B02C 18/305

(Continued)

(56) References Cited

U.S. PATENT DOCUMENTS 3,799,459 A * 3/1974 Bakewell ..... B02C 18/302 241/101.5
4,422,582 A * 12/1983 Roeger ..... B02C 18/30 241/82.5

(Continued)

FOREIGN PATENT DOCUMENTS

| | | |
|---|---|---|
| CN | 2199739 Y | 6/1995 |
| CN | 2764476 Y | 3/2006 |
| EP | 1201312 A1 | 5/2002 |

OTHER PUBLICATIONS

International Search Report dated Dec. 9, 2014 re: Application No. PCT/EP2014/070953; pp. 1-3; citing: U.S. Pat. No. 4,422,582 A and EP 1 201 312 A1.

(Continued)

*Primary Examiner* — Adam J Eiseman
*Assistant Examiner* — Bobby Yeonjin Kim
(74) *Attorney, Agent, or Firm* — Medley, Behrens & Lewis LLC; Lorri W. Cooper

(57) ABSTRACT

A machine for grinding food includes an outlet of a discharge duct for ground food closed by a perforated plate, which is part of a kit of interchangeable plates which has at least a first type with a first type of perforation and a second type with a second type of perforation. The machine further includes an axial coupling and an annular cap. The axial coupling is defined by at least two parts, a first part arranged on the outlet of the discharge duct and a second part arranged on an interchangeable element that is part of a safety kit having at least two mutually different interchangeable elements. The first interchangeable element is compatible both with plates of the first type and plates of the second type as well as an integrated protection body; the second interchangeable element is compatible exclusively with the plates of the second type.

11 Claims, 4 Drawing Sheets

(58) Field of Classification Search
USPC ..... 241/82.1
See application file for complete search history.

(56) References Cited

U.S. PATENT DOCUMENTS

| | | | | |
|---|---|---|---|---|
| 5,289,979 | A * | 3/1994 | Lesar | B02C 18/302 241/260.1 |
| 6,003,797 | A | 12/1999 | Lin | |
| 2007/0090221 | A1 * | 4/2007 | Lesar | B02C 18/2216 241/82.5 |

OTHER PUBLICATIONS

Written Opinion dated Dec. 9, 2014 re: Application No. PCT/EP2014/070953; pp. 1-6; citing: U.S. Pat. No. 4,422,582 A and EP 1 201 312 A1.

* cited by examiner

MACHINE FOR GRINDING FOOD

TECHNICAL FIELD

The present disclosure relates to a machine for grinding food. In the following discussion, explicit reference will be made to meat grinding machines.

BACKGROUND

Meat grinding machines are commonly used, both in household and in professional or industrial environments, in order to reduce the dimensions of fresh or frozen meat by way of a rotating cutter.

In the context of the present disclosure, the term "meat" is used to mean animal meats in general, for example beef, mutton, pork, horsemeat, and also chicken, fish etc.

Conventional meat grinding machines generally comprise a frame (machine body), an electric motor, which is accommodated inside the frame, a section for loading the meat to be ground, and a discharge duct for the ground meat.

Usually, the discharge duct is cylindrical, is extended in a cantilever fashion from the frame, is arranged below the loading section with which it is connected, and contains axially and internally a screw feeder, which is made to rotate by the motor.

The outlet of the discharge duct is closed by a perforated plate, which is kept fixed on the mouth by a locking device. A cutter is interposed between the perforated plate and the screw feeder, and is made to rotate by the motor integrally with the screw feeder. In this manner, the discharge duct defines inside it a meat cutting chamber.

The loading section can be defined by a tray and by a lower feeding neck. The latter leads, on one side, to the bottom of the plate and, on the other side, into the cutting chamber. Depending on the diameter of the neck, there can be a fixed protection plate associated with the neck. In both cases, a pestle helps the operator to push the meat from the tray into the neck, and thus into the cutting chamber.

The loading section can, alternatively, be defined by a hopper and by a lower screw conveyor. In such case, the latter leads, on one side, to the bottom of the hopper and, on the other side, into the cutting chamber.

Examples of meat grinding machines are disclosed in U.S. Pat. No. 6,003,797, CN 2199739Y and CN2764476Y.

Usually, a meat grinding machine is supplied with a kit of interchangeable perforated plates, which have respective mutually different perforations in order to allow a plurality of types of processing with the same machine. The difference in perforation generally includes a different diameter of the holes and/or of a different shape and/or mutual arrangement thereof.

In each instance, the perforated plate selected by the operator is locked onto the outlet of the discharge duct by means of an axial coupling and an annular screw cap. The axial coupling locks the perforated plate in rotation, preventing it from rotating together with the cutter and the meat, while the annular screw cap retains the perforated plate axially, preventing it from being decoupled from the outlet of the discharge duct by being pushed by the meat.

According to some known solutions, the axial coupling is provided by means of a pin, which is provided by casting on the edge of the outlet of the discharge duct in order to be coupled with a slot, or groove, which is defined on the perimetric edge of the perforated plate.

According to other known solutions, the axial coupling is achieved by means of a seat that is defined on the edge of the outlet of the discharge duct in order to be coupled with a protrusion that is defined on the perimetric edge of the perforated plate.

According to the most recent safety regulations, the perforated plate that closes the outlet of the discharge duct can act as an accident prevention device that is capable of protecting the fingers of the operator from the rotating cutter, as long as the diameter of the holes is less than or equal to a set safety diameter, equal to 8 mm. In such case, the meat grinding machine does not require further protection devices associated with the outlet of the discharge duct.

If however, the meat grinding machine allows the use of perforated plates with holes having a larger diameter than the safety diameter, then the machine must mandatorily be provided with a specific protective element, associated with the outlet of the discharge duct, in order to prevent cutting accidents to the fingers of the operator.

In order to prevent the use of perforated plates with holes having a diameter larger than the safety diameter on machines certified for use with plates with holes having a diameter smaller than or equal to the safety diameter, the above mentioned regulations prescribe, on the one hand, that the plates with holes having a diameter smaller than or equal to the safety diameter must be provided with two diametrically opposing peripheral slots, or grooves, while the plates with holes having a diameter larger than the safety diameter must instead be provided with a single peripheral slot, or groove, and, on the other hand, that the machines certified for use with plates with holes having a diameter smaller than or equal to the safety diameter must be designed so that they can only use such type of plates.

Meeting the above mentioned regulations has led, according to the most immediate solution, to the design and sale of two different models, or series, of meat grinding machine which have respective outlets of the discharge duct that are mutually different; specifically, one model provided with two diametrically opposing pins and without the above mentioned protective element, and the other model provided with a single pin and provided mandatorily with the protective element.

The above entails a twofold drawback. In fact, on the one hand it leads to a higher cost of production and/or marketing of the meat grinding machines, and on the other hand it leads to a major limitation of use, and hence of versatility, of the meat grinding machines that are designed and certified for use only with the plates with holes having a diameter smaller than or equal to the safety diameter.

SUMMARY

The aim of the present disclosure is to provide a machine for grinding food, in particular a meat grinding machine, that is devoid of the above mentioned drawbacks.

In particular, the present disclosure provides a machine for grinding food, in particular a meat grinding machine, that is universal with regard to the use of perforated plates and which at the same time meets the current safety regulations.

In other words, the present disclosure provides a machine for grinding food, in particular a meat grinding machine, that is versatile with regard to the use of perforated plates and which at the same time is easy to use and safe.

The present disclosure further provides a machine for grinding food, in particular a meat grinding machine, that complies with safety regulations and which, at the same time, has a relatively low production and/or marketing cost.

BRIEF DESCRIPTION OF THE DRAWINGS

The characteristics of the machine of the present disclosure will become better apparent from the following description of a preferred embodiment, which is illustrated merely for the purposes of non-limiting example in the accompanying drawings, wherein.

DETAILED DESCRIPTION OF THE DRAWINGS

Figure 1:
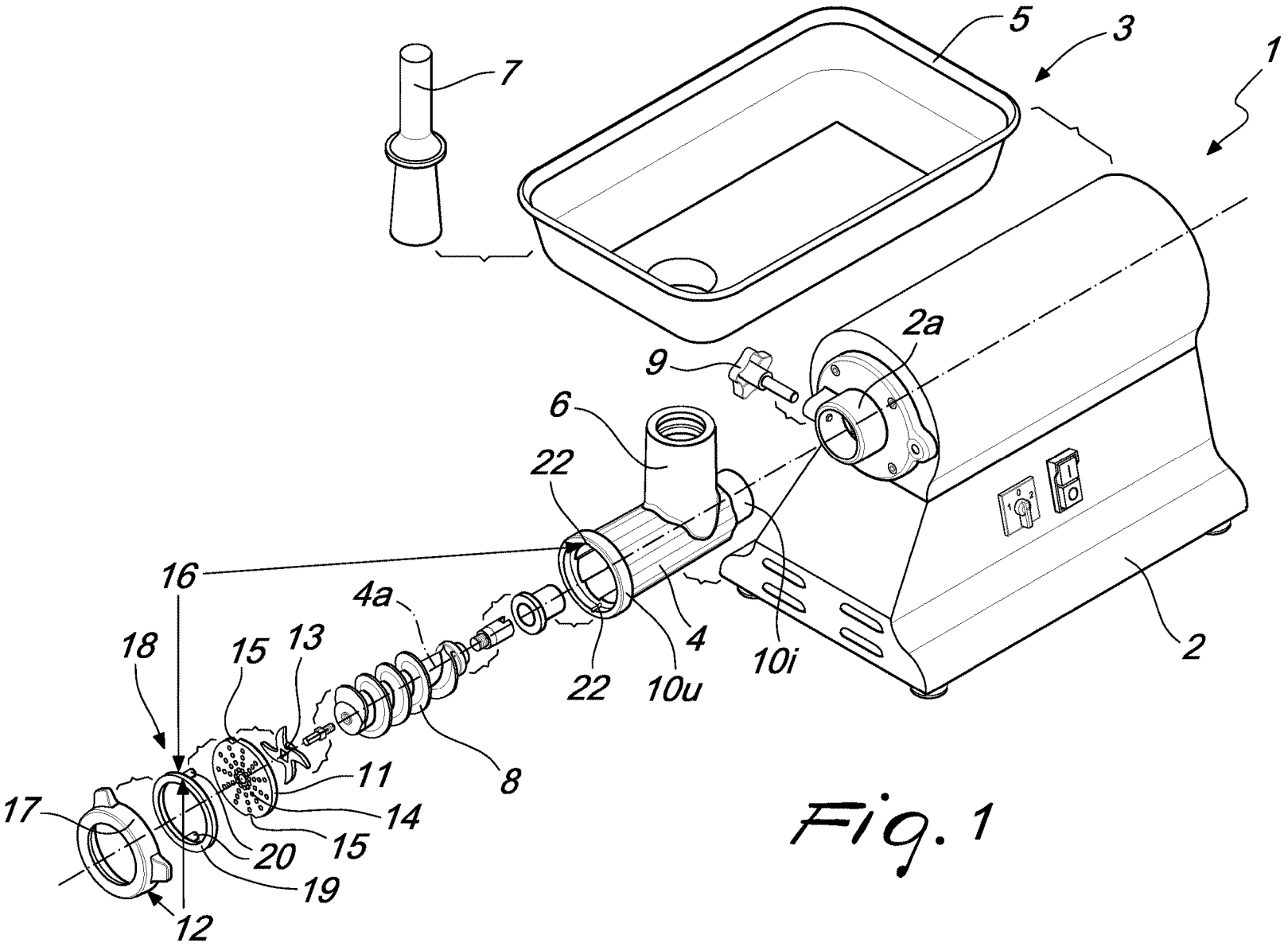
FIG. 1 is an exploded view of a meat grinding machine according to the present disclosure, in a first operating configuration.
Figure 3:
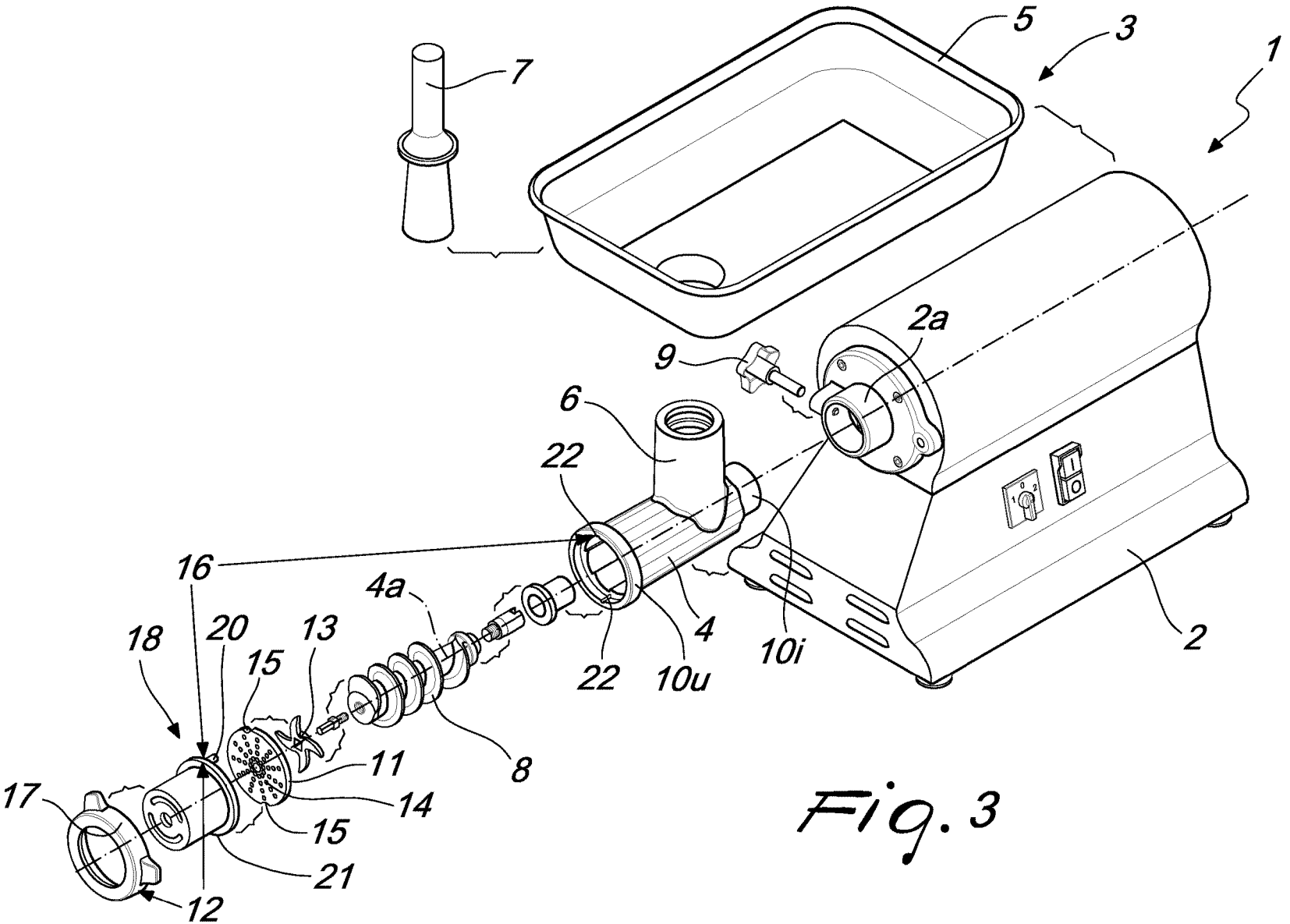
FIG. 3 is an exploded view of the machine in FIG. 1 in a second operating configuration.

With reference to FIGS. 1 and 3, the reference numeral 1 generally designates a machine for grinding food, specifically a meat grinding machine. Therefore, in the example shown here, the term "food" is used specifically to mean meat, where the word "meat" is understood as animal meat in general.

The machine 1 comprises a frame 2, or machine body 2, a section 3 for loading the food to be ground, and a discharge duct 4 for the ground food.

The loading section 3 comprises a tray 5 and a lower feeding neck 6. The neck 6 leads, on one side, to the bottom of the tray 5 and, on the other side, into the duct 4. Depending on the diameter of the neck 6, there can be a fixed protection plate (not shown) associated with the neck 6. In both cases, a pestle 7 helps the operator to push the food from the tray 5 into the neck 6, and thus into the duct 4.

According to a variation of embodiment not shown, the loading section 3 comprises a hopper and a lower screw conveyor. In such case, the screw conveyor leads, on one side, to the bottom of the hopper and, on the other side, into the duct 4.

The duct 4 is substantially cylindrical, is extended in a cantilever fashion from the frame 2, is arranged below the loading section 3 with which it is connected, and contains axially and internally a screw feeder 8, which is made to rotate by an electric motor (not shown) that is accommodated inside the frame 2.

The word "axially" is used to mean the center axis 4*a*, longitudinally extended, of the duct 4.

The duct 4 is mounted detachably on a seat 2*a* of the frame 2 in order to allow an easier cleaning of the machine 1. A removable fixing pin 9 makes it possible to stably fix the inlet 10*i* of the duct 4 to the above mentioned seat 2*a*.

The outlet 10*u* of the duct 4 is closed by a perforated plate 11, which is kept fixed on the outlet 10*u* by a locking device 12. A many-bladed cutter 13 is interposed between the perforated plate 11 and the screw feeder 8, and is made to rotate by the electric motor (not shown) integrally with the screw feeder 8. In this manner, the discharge duct 4 defines inside a food cutting chamber.

The machine 1 is preferably supplied with a kit of interchangeable perforated plates 11, which have respective mutually different perforations in order to allow a plurality of types of processing with the machine 1. The difference in perforation generally includes a different diameter of the holes and/or of a different shape and/or a mutual arrangement thereof.

In particular, the perforated plate 11 closing the outlet 10*u* of the duct 4 is selected by the operator from the above mentioned kit from between at least one first type, which is provided with a first type of perforation, and a second type, which is provided with a second type of perforation. The first type of perforation and the second type of perforation are mutually different, and specifically the first type of perforation is provided with holes 14 having a diameter larger than a set safety diameter, equal to 8 mm, while the second type of perforation is provided with holes having a diameter smaller than or equal to the aforementioned safety diameter. The plates 11 of the second type have further a thickness greater than or equal to 5 mm.

Figure 4:
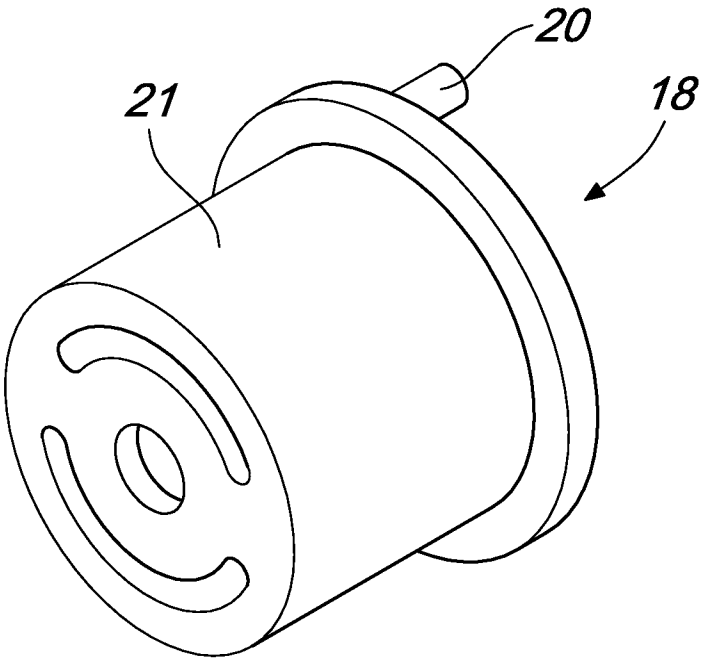
FIG. 4 shows an interchangeable element used in the machine configuration in FIG. 3.

FIG. 3 shows a perforated plate 11 of the first type. As will be better described below, in order to meet the accident prevention safety regulations, the plate 11 of the first type is provided with a single peripheral slot 15, which is defined on the perimetric edge of the plate 11. The single slot 15 uniquely identifies an inferior level of safety of the plate 11 and a corresponding first type of assembly of the machine 1, which has a locking device 12 of a first type (FIGS. 3 and 4).

FIG. 1 shows a perforated plate 11 of the second type.

Figure 2B:
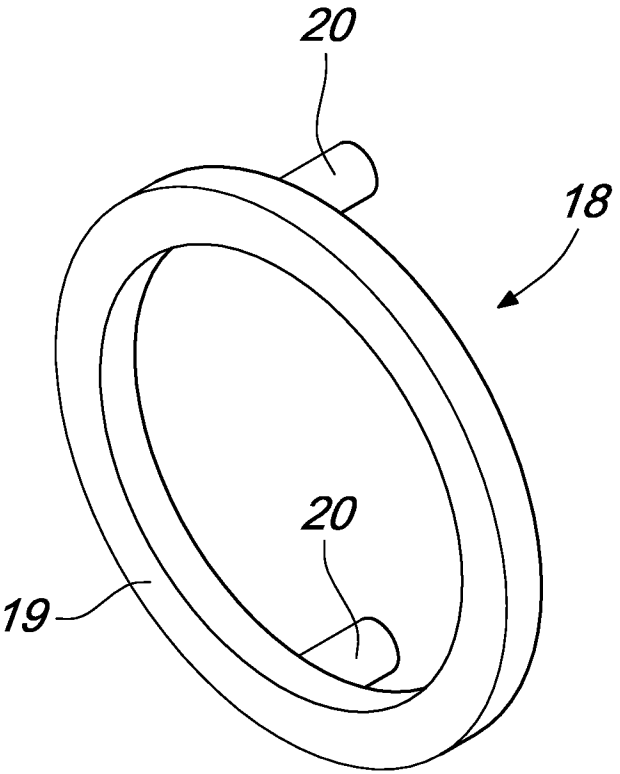
FIGS. 2*a* and 2*b* show an interchangeable element used in the machine configuration in FIG. 1.
Figure 2A:
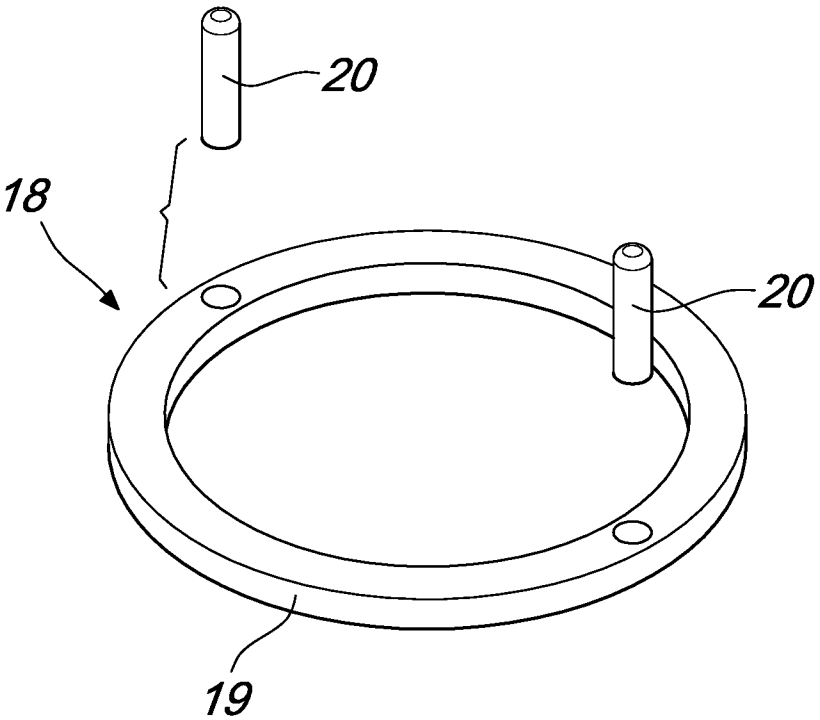

In order to meet the accident prevention safety regulations, the plate 11 of the second type is provided with two diametrically opposing peripheral slots 15, or grooves 15, which are defined on the perimetric edge of the plate 11. The two slots 15 uniquely identify a superior level of safety of the plate 11 and, as will be better described below, a corresponding second type of assembly of the machine 1, which has a locking device 12 of a second type (FIGS. 1, 2*a* and 2*b*).

In each instance, the perforated plate 11 selected by the operator is locked onto the outlet 10*u* of the discharge duct 4 by means of an axial coupling 16 and an annular screw cap 17, which is part of the above mentioned locking device 12.

The axial coupling 16 locks the perforated plate 11 in rotation, preventing it from rotating together with the cutter 13 and the food, while the annular screw cap 17, facing toward the perforated plate 11, retains the perforated plate 11 axially, preventing it from being decoupled from the outlet 10*u* of the discharge duct 4 by being pushed by the food.

The annular cap 17 has an inner female thread that is adapted to be screwed onto an outer male thread of the outlet 10*u* of the duct 4.

It should be noted that the annular cap 17, in its position of fixing to the outlet 10*u*, i.e. in the position in which it is completely screwed onto the outlet 10*u*, retains the perforated plate 11 in the direction of the above mentioned axis 4*a* with a small amount of play. This is due to the need to not tighten the plate 11, in order to have the rotation of the plate 11 prevented solely by the axial coupling 16.

The locking device 12 of the first type comprises a specific first type of axial coupling 16 (FIGS. 3 and 4), while the locking device 12 of the second type comprises a specific second type of axial coupling 16 (FIGS. 1, 2*a* and 2*b*), different from the first; the annular cap 17 is universal, i.e. it does not differ between the two types of locking device 12.

Both types of axial coupling 16 are defined by at least two parts, of which a first part is arranged on the outlet 10*u* of the discharge duct 4 and a second part is arranged on an interchangeable element 18 that is interposed between the perforated plate 11 and the annular cap 17.

The interchangeable element 18 is part of a safety kit that comprises at least two mutually different interchangeable elements 18, of which a first interchangeable element 18 is compatible both with the plates 11 of the first type and with the plates 11 of the second type, and has an integrated protection body that is adapted to prevent cutting accidents from happening to the operator, while the second interchangeable element 18 is compatible exclusively with the plates 11 of the second type and is lacking the aforementioned protection body.

It should be noted that, according to the accident prevention safety regulations, the use of the plates 11 of the first type mandatorily requires the use of an auxiliary protection device associated with the outlet 10*u* of the discharge duct 4, while the plates 11 of the second type can act on their own as an accident prevention device that is capable of protecting the fingers of the operator from the rotating cutter, hence they do not mandatorily require the use of the aforementioned auxiliary protection device.

The interchangeable element 18 that is part of the first type of axial coupling 16 comprises a extruder cup body 21, which is provided with a certain number n1 of pins 20 and defines the above mentioned protection body. In particular, the interchangeable element 18 that is part of the first type of axial coupling 16 is provided with a single pin 20 and defines, with its cap shape, a protective device for the fingers of the operator (FIGS. 3 and 4).

Here, the single pin 20 defines the above mentioned second part of the axial coupling 16 and is adapted to function between the outlet 10*u* of the duct 4 and the single slot 15 of the plate 11 that requires additional protection (plate 11 of the first type), or indeed with the two slots 15 of a plate 11 that does not require additional protection (plate 11 of the second type), thus ensuring, in the latter case, a redundant protection.

The interchangeable element 18 that is part of the second type of axial coupling 16 comprises instead an annular body 19 that is provided with a certain number n2 of pins 20, in particular a pair 20 of diametrically opposing pins (FIGS. 1, 2*a* and 2*b*).

Here, the two pins 20 define the above mentioned second part of the axial coupling 16 and each pin 20 is adapted to function between the outlet 10*u* of the duct 4 and a respective slot 15 of only the plates 11 that do not mandatorily require additional protection.

The interchangeable elements 18 are essential for the operation of the machine 1 and their differentiation in terms of the level of safety of the plate 11 are as components of a safety kit of the machine 1.

In order to ensure the maximum safety and/or in order to prevent hazardous tampering by the operator, each pin 20 is mounted fixed and undetachable both on the annular body 19 and, respectively, on the extruder cup body 21.

Preferably, the annular body 19 and the extruder cup body 21 are made of food-grade plastics, while the respective pins 20 are made of steel.

According to a variation, both the annular body 19 and the extruder cup body 21 are provided in a single piece with the respective pins 20, in food-grade plastics or in steel.

Figure 5:
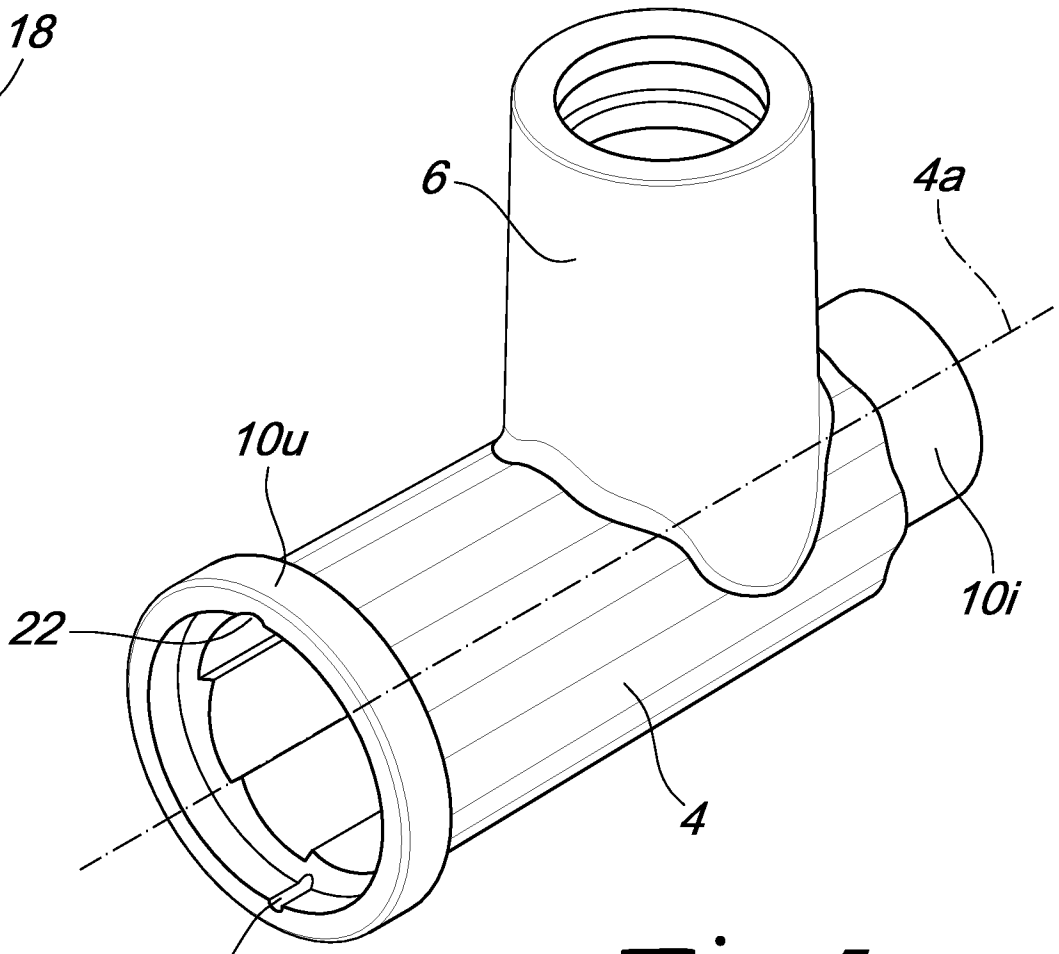
FIG. 5 is an enlarged view of a component of the machine in FIG. 1.

In order to make the outlet 10*u* of the duct 4 fully compatible with both of the interchangeable elements 18 described above, as shown in FIG. 5, the outlet 10*u* is provided internally with at least two longitudinal slots 22, or grooves 22, which are each adapted to accommodate a pin 20. In particular, the outlet 10*u* is provided internally with only two slots 22, which are arranged diametrically opposing. The two slots 22 are defined in the inner surface of the duct 4 and extend in the direction of the axis 4*a* from the outer rim of the outlet 10*u* inwardly by a length greater than the length of the pin 20 so as to be able to accommodate it completely.

The two slots 22 of the outlet 10*u* of the duct 4 define the above mentioned first part of the axial coupling 16, specifically the fixed, i.e. non-interchangeable, part of the axial coupling 16.

The disclosure as described above enables the production of a machine that has a safety kit that can be used immediately and is low cost.

In particular, the disclosure makes it possible to produce a machine that is universal with regard to the use of perforated plates and which at the same time meets the current safety regulations.

Furthermore, the proposed disclosure makes it possible to produce a machine that, on the one hand, complies with safety regulations and, on the other hand, has a relatively low production and/or marketing cost.

Finally it should be noted that the disclosure thus conceived is clearly susceptible of industrial application; it is susceptible of numerous modifications and variations.

The disclosures in Italian Patent Application No. BO2013A000540 from which this application claims priority are incorporated herein by reference.

The invention claimed is:

1. A system for grinding food, comprising: a machine for grinding food comprising a section configured for loading the food to be ground and a discharge duct for the ground food; said discharge duct having an axis thereof that extends longitudinally and an outlet for the ground food; a kit of interchangeable plates which comprises at least a first type of plate, having a first type of perforation, and a second type of plate, having a second type of perforation, said outlet being closed by one of said plates; and a safety kit comprising at least first and second mutually different interchangeable elements; locking means being provided for keeping said plate fixed on said outlet; said locking means comprising at least one axial coupling for locking said plate in rotation, and an annular cap that is facing toward said plate and fixed on said outlet in order to retain said plate in the direction of said axis; said axial coupling being defined by a first part is-arranged on said outlet of said discharge duct, a second part arranged on one of said first and second interchangeable elements, and the annular cap, with the interchangeable elements interposed between said plate and said annular cap, wherein the axial coupling comprises a part that extends between the interchangeable element, the plate, and into the discharge duct to retain the plate between the interchangeable element and the outlet of the discharge duct, with the plate being retained axially therebetween with some play such that rotation of the plate is prevented solely by the interchangeable elements; and said first interchangeable element is compatible both with said first type of plate and with said second type of plate, and has an integrated protection body that is adapted to prevent cutting accidents from happening to the operator, while said second interchangeable element is compatible exclusively with said second type of plate and lacks said protection body.

2. The system according to claim 1, wherein said plate has at least one slot, or groove, which is defined on the perimetric edge thereof; the axial coupling comprising at least one pin, which is arranged on at least one of said interchangeable elements and functions between said outlet and the slot, or groove, of the plate in order to lock the plate in rotation, and the outlet includes one or more recesses for receiving the at least one pin.

3. The system according to claim 2, wherein said first interchangeable element comprises an extruder cup body that is provided with a single pin; and said second interchangeable element comprises an annular body that is provided with a pair of pins, which are diametrically opposing.

4. The system according to claim 3, wherein said extruder cup body defines said protection body that is adapted to prevent cutting accidents from happening to the operator.

5. The system according to claim 1, wherein at least one of said interchangeable elements is made of food-grade plastics.

6. The system according to claim 3, wherein said single pin or pair of pins is mounted fixed and undetachable on said corresponding interchangeable elements.

7. The system according to claim 3, wherein said single pin or pair of pins is made of steel.

8. The system according to claim 3, wherein said single pin or pair of pins and said corresponding interchangeable element are provided in a single piece, in food-grade plastics or in steel.

9. The system according to claim 2, wherein the recesses of said outlet are provided internally with the recesses being at least two longitudinal slots or grooves which are each adapted to accommodate said pin; said slots or grooves of the outlet defining said first part of the axial coupling.

10. The system according to claim 1, wherein said annular cap, in a position of fixing to the outlet, retains the plate in the direction of said axis with play.

11. The system according to claim 1, wherein the protection body extends outwardly through the annular cap.

* * * * *